US008036389B2

(12) United States Patent
Cho

(10) Patent No.: US 8,036,389 B2
(45) Date of Patent: Oct. 11, 2011

(54) APPARATUS AND METHOD OF CANCELING VOCAL COMPONENT IN AN AUDIO SIGNAL

(75) Inventor: Yong-choon Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1234 days.

(21) Appl. No.: 11/500,295

(22) Filed: Aug. 8, 2006

(65) Prior Publication Data

US 2007/0076891 A1 Apr. 5, 2007

(30) Foreign Application Priority Data

Sep. 26, 2005 (KR) ..... 10-2005-0089504

(51) Int. Cl.
*H04R 5/00* (2006.01)

(52) U.S. Cl. ..... 381/1; 381/93; 381/94.1; 381/98; 381/17

(58) Field of Classification Search ..... 381/92, 381/94.1, 94.2, 94.9, 98, 26, 2, 93, 83, 22, 381/63, 66, 17, 1, 27, 309, 18, 61
See application file for complete search history.

(56) References Cited

U.S. PATENT DOCUMENTS

| | | | | |
|---|---|---|---|---|
| 4,139,728 | A | 2/1979 | Haramoto et al. | |
| 5,701,344 | A | 12/1997 | Wakui | |
| 5,939,656 | A | 8/1999 | Suda | |
| 6,449,368 | B1 | 9/2002 | Davis et al. | |
| 6,690,799 | B1 * | 2/2004 | Iwase et al. | 381/17 |
| 2002/0136412 | A1 * | 9/2002 | Sugimoto | 381/1 |
| 2005/0041814 | A1 * | 2/2005 | Chen | 381/1 |
| 2006/0023889 | A1 * | 2/2006 | Suzaki et al. | 381/17 |

FOREIGN PATENT DOCUMENTS

| | | | |
|---|---|---|---|
| JP | 03-021200 | | 1/1991 |
| JP | 05191894 | A * | 7/1993 |
| JP | 7-311585 | | 11/1995 |
| JP | 9-84198 | | 3/1997 |
| JP | 2001-8299 | | 1/2001 |
| JP | 2003299183 | A * | 10/2003 |
| KR | 10-194658 | | 2/1999 |

OTHER PUBLICATIONS

Search Report dated Apr. 1, 2008, from Dutch Patent Office with respect to Dutch Patent Application No. 1032500.

* cited by examiner

*Primary Examiner* — Vivian Chin
*Assistant Examiner* — Leshui Zhang
(74) *Attorney, Agent, or Firm* — Stanzione & Kim, LLP

(57) ABSTRACT

An apparatus and method of canceling a vocal component includes a first vocal canceling unit to delay each of the left and right channel input signals for a predetermined time and to feed-forward cross mix the delayed left and right channel signals with the left and right channel input signals, a sound stage widening unit to delay each of the left and right channel signals output from the first vocal canceling unit for a predetermined time and to feedback cross mix the signal of each delayed channel signals with the left and right channel signals, and a second vocal canceling unit to low-pass filter the left and right channel signals output from the sound stage widening unit and to mix the low-pass filtered left and right low frequency components and a high frequency component of the difference between the left and right channels to cancel the vocal component from an audio signal.

21 Claims, 4 Drawing Sheets

APPARATUS AND METHOD OF CANCELING VOCAL COMPONENT IN AN AUDIO SIGNAL

CROSS-REFERENCE TO RELATED APPLICATIONS

This application claims priority under 35 U.S.C. 119(a) from Korean Patent Application No. 10-2005-0089504, filed on Sep. 26, 2005, in the Korean Intellectual Property Office, the disclosure of which is incorporated herein in its entirety by reference.

BACKGROUND OF THE INVENTION

1. Field of the Invention

The present general inventive concept relates to a karaoke system, and more particularly, to a vocal canceling apparatus and method of canceling a vocal component in a karaoke system.

2. Description of the Related Art

Generally, a karaoke system uses as an accompaniment, in which an audio signal is output from an audio device, such as a cassette player, a compact disc player or a tuner, and in which only a human vocal component is canceled. Most vocal components exist in a frequency band of 200 Hz to 4 kHz in the audio signal. A vocal signal is a single signal, that is, a mono signal, in an audio system. A music signal including sound of musical instruments is separated into a left channel and a right channel. Accordingly, except for the mono signal, waveforms of the audio signal input to a left channel terminal and the audio signal input to a right channel terminal are different to each other. Therefore, if the audio signal input to the left channel is subtracted from the audio signal input to the right channel, the audio signal in which the vocal signal is canceled can be generated. Generally, in a method of canceling a vocal component in a stereo music file, a difference between the left and right channels is obtained to cancel the vocal component since the vocal component, that is, voice of a singer, is located at a center channel of the audio signal.

U.S. Pat. No. 6,690,799 B1 discloses a 'stereo signal processing apparatus' relating to a vocal canceling circuit.

FIG. 1 is a block diagram illustrating a conventional vocal canceling apparatus. Referring to FIG. 1, right channel filter units 121 and 122 extract a low frequency signal and a high frequency signal from a right channel signal Rin. Left channel filter units 111 and 112 extract a low frequency signal and a high frequency signal from a left channel signal Lin. A subtraction unit 131 generates a vocal canceling signal by subtracting the right channel signal Rin from the left channel signal Lin. A left addition unit 113 generates a left channel output signal Lout by adding the low frequency signal and high frequency signal of a left channel from the left channel filter units 111 and 112 and the vocal canceling signal from the subtraction unit 131. A right addition unit 123 generates a right channel output signal Rout by adding the low frequency signal and high frequency signal of the right channel from the right channel filter units 121 and 122 and the vocal canceling signal from the subtraction unit 131.

Accordingly, the vocal canceling circuit of FIG. 1 adds a low frequency component and a high frequency component to a signal obtained according to a difference between the two channel signals. However, there is a drawback that cut off frequencies of a low frequency pass filter and a high frequency pass filter should always be accurately set with respect to a sound source. Also, when a signal of the frequency band of 200 Hz to 4 kHz to which human ears are sensitive becomes a mono signal, the signal outputs a very hard and dry sound compared to the original sound.

SUMMARY OF THE INVENTION

The present general inventive concept provides a vocal canceling apparatus and method capable of easily implementing a karaoke mode using an ordinary stereo file by attenuating a vocal component with using a cross mix structure in a stereo channel audio signal.

The present general inventive concept also provides a karaoke system capable of easily implementing a karaoke mode using an ordinary stereo file by attenuating a vocal component with using a cross mix structure in a stereo channel audio signal.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an apparatus to cancel a vocal component, the apparatus comprising a first vocal canceling unit to delay each of left and right channel input signals for a predetermined time and to feed-forward cross mix the delayed left and right channel input signals with the right and left channel input signals, a sound stage widening unit to delay each of the left and right channel signals output from the first vocal canceling unit for a predetermined time and to feedback cross mix the delayed left and right channel signals with the right and left channel signals to generate second left and right channel signals, and a second vocal canceling unit to low-pass filter the second left and right channel signals output from the sound stage widening unit and to cancel a vocal component by mixing the low-pass filtered second left and right channel signals having low frequency components, and a high frequency component of a difference between the second left and right channels to generate final left and right channel signals.

The foregoing and/or other aspects of the present general inventive concept may also be achieved by providing a karaoke system comprising an audio source generation unit to generate an audio source as left and right channels, a decoder unit to decode the audio source generated in the audio source generation unit according to a predetermined signal format, and a vocal canceling unit to feed-forward-cross mix the left and right channel input signals decoded in the decoder unit with a predetermined delay to generate left and right channel signals, to feedback-cross mix the mixed left and right channel signals with a predetermined delay to generate second left and right channel signals, to low-pass filter the second left and right channel signals, and to mix the low-pass filtered left and right channel signals of low frequency components, and a high frequency component of a difference between the second left and right channel signals.

The foregoing and/other aspects of the present general inventive concept may also be achieved by providing a method of canceling a vocal component, the method comprising delaying one channel signal of left and right channel input signals and canceling a vocal component by feed-forward cross mixing the delayed left and right channel input signals with the right and left channel input signals in order to cancel a portion of the vocal component, delaying the left and right channel signals and widening a sound stage by feedback-cross summation of the delayed left and right channel signals with the right and left channel signals in order to widen the sound stage, and low-pass filtering the output left and right channel signals and canceling a second portion of the vocal component by mixing the low-pass filtered left and right channel signals having low frequency components, and a high frequency component of a difference between the left and right channels in order to cancel a second portion of the vocal component.

The foregoing and/other aspects of the present general inventive concept may also be achieved by providing a computer readable recording medium containing computer readable codes to perform a method, the method including delaying left and right channel input signals and feed-forward cross mixing the delayed channel input signals with the right and left channel input signals to cancel a first vocal component from the left and right channel input signals to generate left and right channel signals, delaying the left and right channel signals and feedback-cross mixing the delayed left and right channel input with the left and right signals to widen a sound stage to generate second left and right channel signals, and low-pass filtering the second left and right channel signals and the mixing the low-pass filtered second left and right channel signals of low frequency components and a high frequency component of a difference between the second left and right channels to cancel a vocal component to generate final left and right channel signals.

The foregoing and/other aspects of the present general inventive concept may also be achieved by providing an apparatus to cancel a vocal component from an audio signal, including a first vocal canceling unit to delay or gain control left and right channel input signals and to add the delayed or gain-controlled left and right channel input signals to the right and left channel input signals, respectively, to generate left and right channel signals, and a second vocal canceling unit to obtain low frequency components from the left and right channel signals, to obtain a high frequency component from a difference between the left and right channel signals, and to add the high frequency component to each of the low frequency components of the left and right channel signals to generate final left and right channel signals.

The foregoing and/other aspects of the present general inventive concept may also be achieved by providing an apparatus to cancel a vocal component from an audio signal, the apparatus including a sound stage widening unit to delay or gain-control left and right channel signals and to add the delayed or gain-controlled left and right channel signals to the right and left channel signals to generate second left and right channel signals, and a vocal canceling unit to obtain low frequency components from the second left and right channel signals, to obtain a high frequency component from a difference between the second left and right channel signals, and to add the high frequency component to each of the low frequency components of the second left and right channel signals to generate final left and right channel signals.

The foregoing and/other aspects of the present general inventive concept may also be achieved by providing an apparatus to cancel a vocal component from an audio signal, the apparatus including a first vocal canceling unit to cancel a first vocal component from left and right channel input signals to generate left and right channel signals, a sound stage widening unit to widen a sound stage of the left and right channel signals to generate second left and right channel signals, and a second vocal canceling unit to cancel a second left and right channel signals to generate final left and right channel signals of an audio signal.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
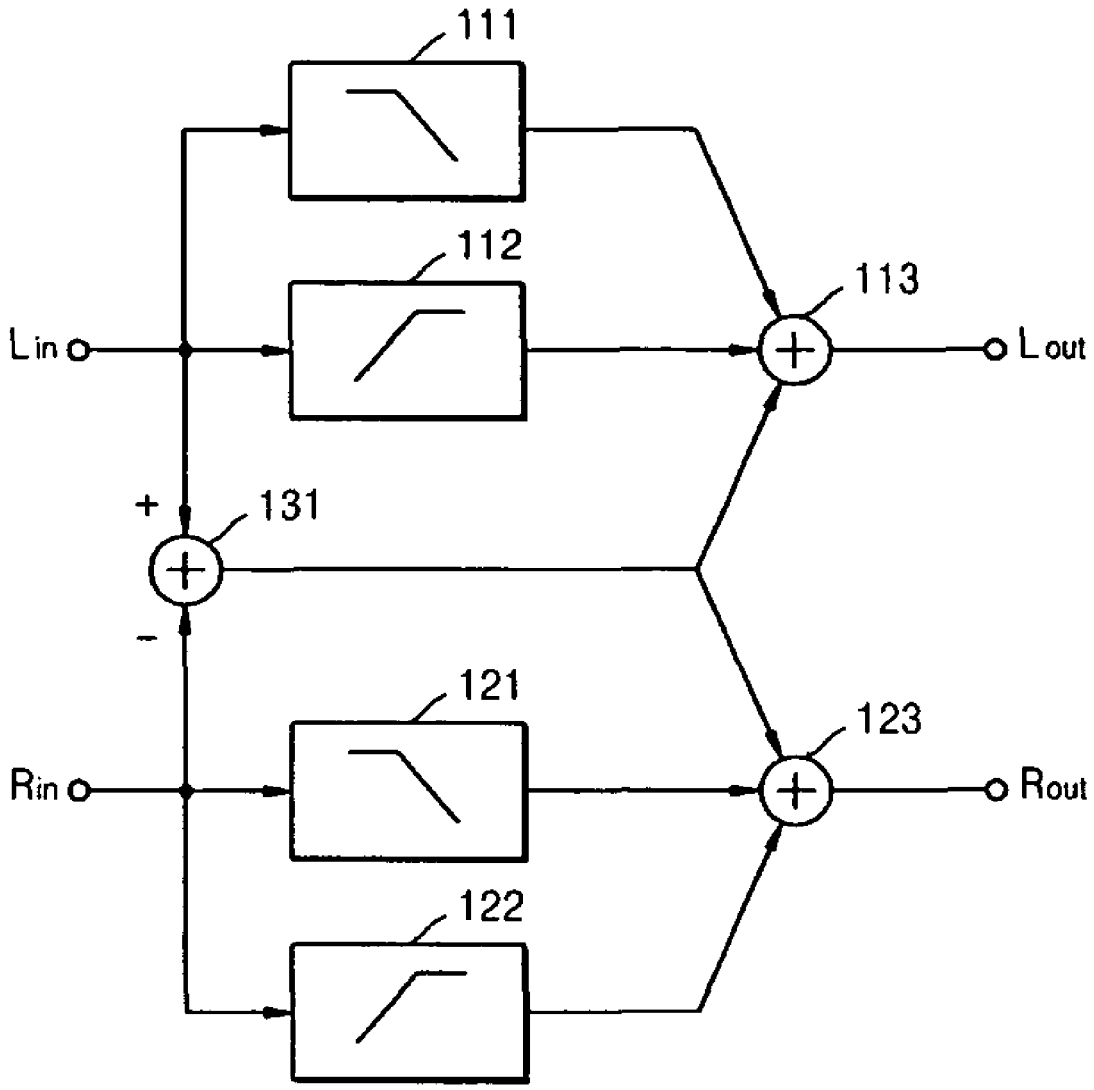
FIG. 1 (PRIOR ART)
FIG. 1 is a block diagram illustrating a conventional vocal canceling apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
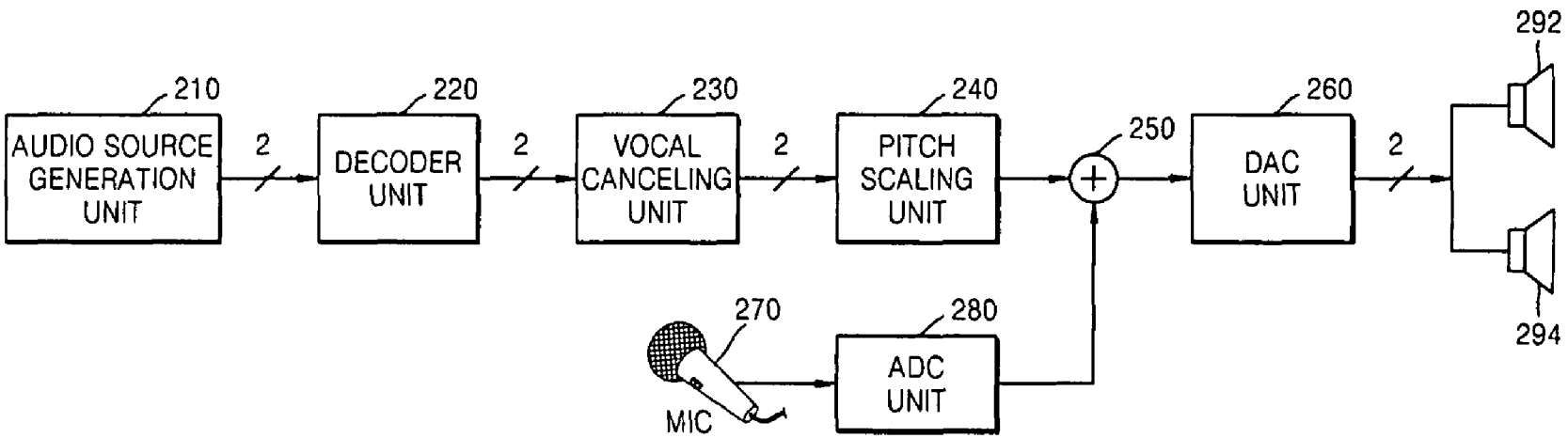
FIG. 2 is a block diagram illustrating an entire karaoke system having a vocal canceling apparatus according to an embodiment of the present general inventive concept.

FIG. 2 is a block diagram illustrating a karaoke system having a vocal canceling apparatus according to an embodiment of the present general inventive concept.

Referring to FIG. 2, an audio source generation unit 210 may be an audio reproducing apparatus, such as a cassette player, a compact disc player, or a tuner. The audio source generation unit 210 outputs an audio source signal having 2 channels, for example, left and right channels.

A decoder unit 220 decodes the left and right channel audio source signals generated in the audio source generation unit 210 according to a signal format such as the MP3 format, and outputs signals as pulse coded modulation (PCM) data.

A vocal canceling unit 230 cancels a first vocal component of the left and right channel input signals decoded in the decoder unit 220 through a feed-forward cross mixing structure having a gain and delay, widens a stereo sound stage of a signal in which the first vocal component is canceled through a feedback cross mixing structure, low-pass filters the widened left and right channel signals, and cancels a second vocal component by mixing the low frequency components of the low-pass filtered left and right channels and the high frequency component of the difference between the left and right channels.

A pitch scaling unit 240 adjusts a pitch of the audio signal in which the vocal component is canceled in the vocal canceling unit 230.

An addition unit 250 adds a voice signal input through a microphone 270 and an analog-to-digital converter (ADC) unit 280 to the audio signal output from the pitch scaling unit 240 to generate a digital audio signal.

A digital-to-analog converter (DAC) unit 260 converts the digital audio signal output from the addition unit 250 into an analog audio signal having the two channels, for example, left and right channels.

A left speaker 292 and a right speaker 294 reproduce the left and right channel analog audio signals, respectively, output from the DAC unit 260.

Figure 3:
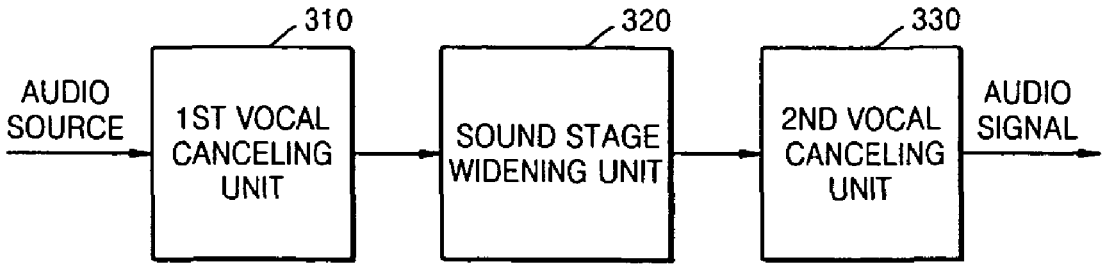
FIG. 3 is a block diagram illustrating a vocal canceling apparatus according to an embodiment of the present general inventive concept.

FIG. 3 is a block diagram illustrating a vocal canceling apparatus according to an embodiment of the present general inventive concept.

Referring to FIG. 3, the vocal canceling apparatus includes a first vocal canceling unit 310, a sound stage widening unit 320, and a second vocal canceling unit 330.

The first vocal canceling unit 310 has a feed-forward cross mix structure having a delay value ($Z^{-n}$) of a short length, and a gain value ($G_0$). The first vocal canceling unit 310 delays each of the left and right channel input signals for a short time and feed-forward cross mixes the signal of each delayed channel with the input signal of the other channel to cancel a first vocal component therefore to generate left and right channel signals.

The sound stage widening unit 320 has a feedback cross mix structure having a second delay value ($Z^{-n}$) of an appropriate length, and a second gain value ($G_1$). The sound stage widening unit 320 delays each of the left and right channel signals output from the first vocal canceling unit 310 for an appropriate time and feedback cross mixes the signal of each delayed channel with the input signal of the other channel to widen a sound stage of the left and right channel signals.

The first vocal canceling unit 310 and the sound stage widening unit 320 lower a low frequency component and raise a high frequency component. Accordingly, since the increase in the high frequency component (for example, 3 kHz) increases clearness of the vocal component, a frequency component greater than or equal to a predetermined frequency should be restricted through a low pass filter. Also, since low-pass filtered left and right channel signals lower realism of the sound and a stereo widening effect, a high frequency component of a signal obtained according to a difference between the left and right channel signals is added to the low-pass filtered left and right channel signals. That is, the second vocal canceling unit 330 low-pass filters the left and right channel signals output from the sound stage widening unit 320 and mixes the low frequency components of the low-pass filtered left and right channels with the high frequency component of the difference between the left and right channel signals.

Figure 4:
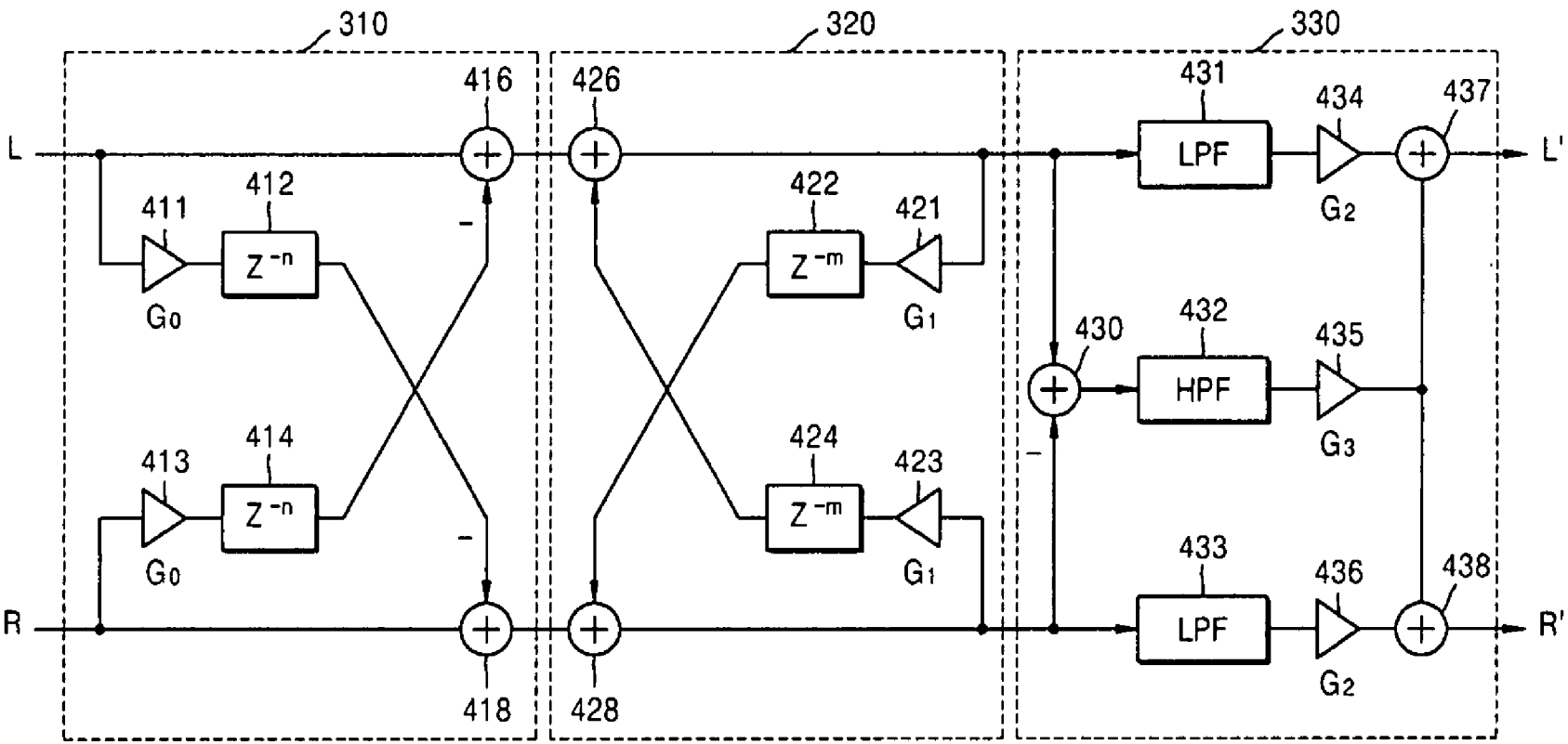
FIG. 4 is a detailed diagram illustrating the vocal canceling apparatus of FIG. 3.

FIG. 4 is a detailed diagram illustrating the vocal canceling apparatus of FIG. 3.

Referring to FIGS. 3 and 4, the first vocal canceling unit 310 will now be explained.

In order to adjust a gain reduction of a voice band, first and second gain adjusters 411 and 413 adjust gains of signals input to left and right channels L and K, respectively. The first and second gain adjusters 411 and 413 have predetermined gain values ($G_0$).

In order to leave the high frequency component and low frequency component included in a voice band, first and second delay units 412 and 414 delay the left and right channel input signals whose gains are adjusted in the first and second gain adjusters 411 and 413, for a predetermined time. The first and second delay units 412 and 414 may have short delay values ($Z^{-n}$) of 1 to 2 sampling times of the left and right channel input signals.

A first left subtracter 416 subtracts the gain-adjusted and delayed right channel input signal from the left channel input signal. A first right subtracter 418 subtracts the gain-adjusted and delayed left channel input signal from the right channel input signal.

Accordingly, the first vocal canceling unit 310 cancels a component having a high similarity between channels with respect to time. The first vocal canceling unit 310 cancels only a stationary component, that is, the vocal component, by obtaining the difference between the two channels using a technique of cross mixing with a short delay. Accordingly, an unstationary (or non-identical characteristic) component is not canceled in the first left subtracter 416 and the first right subtracter 418 such that a sound stage can be widened.

The sound stage widening unit 320 will now be explained.

Third and fourth gain adjusters 421 and 423 adjust gains of the signals input to the left and right channels.

The third and fourth gain adjusters 421 and 423 have second predetermined gain values ($G_1$).

Third and fourth delay units 422 and 424 delay the left and right channel input signals whose gains are adjusted in the third and fourth gain adjusters 421 and 423 for a predetermined time. The third and fourth delay units 422 and 424 may have delay values (Z-m) longer than those of the delay units 412 and 414 of the first vocal canceling unit 310.

A second left adder 426 adds the left channel signal and the gain-adjusted and delayed right channel signal. A second right adder 428 adds the right channel input signal and the gain-adjusted and delayed left channel signal.

Accordingly, by cross mixing the two channel signals with an appropriate delay, the sound stage widening unit 320 slightly widens the sound stage, which is narrowed in the first vocal canceling unit 310. The delay value ($Z^{-m}$) may be longer than the delay value in the first vocal canceling unit 310 so that a sufficient sound stage can be obtained.

The second vocal canceling unit 330 will now be explained.

A left and right subtracter 430 cancels a vocal component by performing subtraction of the left channel signal and the right channel signal output from the sound stage widening unit 320.

A high pass filer 432 passes the high frequency component of the signal output from the left and right subtracter 430.

A left low pass filter 431 passes a low frequency component in order to restrict the high frequency component of the left channel signal output from the sound stage widening unit 320. Accordingly, the left low pass filter 431 can cancel a sufficient vocal component by reducing clearness caused by the high frequency component.

A right low pass filter 433 passes a low frequency component in order to restrict the high frequency component of the right channel signal output from the sound stage widening unit 320. Accordingly, the right low pass filter 431 can cancel a sufficient vocal component by reducing the clearness caused by the high frequency component.

Fifth, sixth, and seventh gain adjusters 434, 435, and 436 adjust gains of signals output from the left low pass filter 431, the high pass filter 432, and the right low pass filter 433, respectively. The fifth, sixth, and seventh gain adjusters 434, 435, and 436 have respective predetermined gain values ($G_2$, $G_3$, $G_2$).

In order to increase realism of the sound and the wide stereo effect, a third left adder 437 adds a signal output from the fifth gain adjuster 434 of a low frequency band to a signal output from the sixth gain adjuster 435 of a high frequency band, and outputs a final left channel signal (L').

In order to increase the realism of the sound and the wide stereo effect, a third right adder 437 adds a signal output from the seventh gain adjuster 436 of a low frequency band to a signal output from the sixth gain adjuster 435 of a high frequency band, and outputs a final right channel signal (R').

Accordingly, the third left adder 437 and the third right adder 438 increase the realism of the sound and the wide stereo effect, by mixing the low-pass filtered signal with a high frequency component of the difference between the two channels.

The present general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the present general inventive concept, the vocal canceling apparatus may be constituted with the first vocal canceling unit to delay or gain control left and right channel input signals and to add the delayed or gain-controlled left and right channel input signals to the right and left channel input signals, respectively, to generate left and right channel signals, and the second vocal canceling unit to obtain low frequency components from the left and right channel signals, to obtain a high frequency component from a difference between the left and right channel signals, and to add the high frequency component to each of the low frequency components of the left and right channel signals to generate final left and right channel signals in which the vocal component of the left and right channel input signals has been removed.

It is possible that the vocal canceling apparatus may be constituted with the sound stage widening unit to delay or gain-control left and right channel signals and to add the delayed or gain-controlled left and right channel signals to the right and left channel signals to generate second left and right channel signals, and the second vocal canceling unit to obtain low frequency components from the second left and right channel signals, to obtain a high frequency component from a difference between the second left and right channel signals, and to add the high frequency component to each of the low frequency components of the second left and right channel signals to generate final left and right channel signals, in which the vocal component of the left and right channel input signals has been removed.

Although the present embodiment illustrates the two channel input signals and two final channel signals, the present general inventive concept is not limited thereto. It is possible to generate three or more final channel signals using two or more channel input signals in the vocal cancelling apparatus of an audio system, such as the karaoke system.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to cancel a vocal component from an audio signal, comprising:

a first vocal canceling unit to delay each of left and right channel input signals for a predetermined time and to feed-forward cross mix the delayed left and right channel input signals with the right and left channel input signals to generate left and right channel signals;

a sound stage widening unit to delay each of the left and right channel signals output from the first vocal canceling unit for a predetermined time and to feedback-cross mix the delayed left and right channel signals with the right and left channel signals to generate second left and right channel signals; and a second vocal canceling unit including a left and right low pass filter directly connected to the sound stage widening unit to low-pass filter the second left and right channel signals and restrict a high frequency component output from the sound stage widening unit, the second vocal canceling unit including a high-pass filter to output a high frequency component of a difference between the second left and right channel signals to cancel a second vocal component, and to mix the low-pass filtered left and right channel signals of low frequency components output from the low pass filters with the high-pass frequency component output from the high-pass filter to generate a final left and right channel signals.

2. The apparatus of claim 1, wherein the first vocal canceling unit comprises:

left and right gain adjusting units to adjust gains of the left and right channel input signals;

left and right signal delay units to delay the gain-adjusted left and right channel input signals adjusted in the left and right gain adjusting units, for a predetermined time;

a first left subtraction unit to subtract the delayed right channel input signal delayed in the right delay unit from the left channel input signal to cancel a vocal component of the left channel; and a first right subtraction unit to subtract the delayed left channel input signal delayed in the left delay unit from the right channel input signal to cancel a vocal component of the right channel.

3. The apparatus of claim 2, wherein the left and right signal delay units delay input signals for a predetermined sample period of the left and right channel input signals.

4. The apparatus of claim 1, wherein the sound stage widening unit comprises:

left and right gain adjusting units to adjust gains of the left and right channel signals;

left and right signal delay units to delay the gain adjusted left and right channel signals adjusted in the left and right gain adjusting units;

a second left addition unit to add the left channel signal and the delayed right channel signal feedback-delayed through the right signal delay unit to widen a sound stage of the left channel signal; and a second right addition unit to add the right channel signal and the delayed left channel signal feedback-delayed through the left signal delay unit to widen a sound stage of the right channel signal.

5. The apparatus of claim 1, wherein the second vocal canceling unit comprises:

a signal subtraction unit to subtract the second left channel signal from the second right channel signal;

a left low pass filter to pass a low frequency component of the left second channel signal;

a right low pass filter to pass a low frequency component of the second right channel signal;

a high pass filter to pass a high frequency component of a signal output from the signal subtraction unit;

a third left addition unit to add signals output from the left low pass filter and the high pass filter; and a third right addition unit to add signals output from the right low pass filter and the high pass filter.

6. A method of canceling a vocal component from an audio signal, the method comprising:

delaying left and right channel input signals and feed-forward cross mixing the delayed left and right channel input signals with the right and left channel input signals to cancel a first vocal component from the left and right channel input signals to generate left and right channel signals;

delaying the left and right channel signals and feedback-cross mixing the delayed left and right channel signals with the right and left channel signals to widen a sound stage to generate second left and right channel signals; and low-pass filtering the second left and right channel signals of the sound stage to restrict high frequency components therefrom, and high-pass filtering a difference between the second left and right channel signals that cancel a second vocal component to restrict low-pass frequency components from the output of the high-pass filtering, and mixing the low-pass filtered second left and right channel signals of low frequency components output from the low pass filtering with a high frequency component output from the high-pass filtering to generate final left and right channel signals.

7. The method of claim 6, wherein the canceling of the first vocal component comprises:

canceling the first vocal component of the left channel input signal by performing subtraction of the left channel input signal and the delayed right channel input signal delayed for a predetermined sample period;

canceling the first vocal component of the right channel input signal by performing subtraction of the right channel input signal and the delayed left channel input signal delayed for a predetermined sample period.

8. The method of claim 6, wherein the widening of the sound stage comprises:

widening the sound stage of the left channel by summing the left channel signal and the feedback delayed right channel signal; and widening the sound stage of the right channel signal by summing the right channel signal and the feedback delayed left channel signal.

9. The method of claim 6, wherein the canceling of the second vocal component comprises:

subtracting the second left channel signal from the second right channel signals to generate a subtracted signal;

passing a high frequency component of the subtracted signal;

adding the low-pass filtered second left channel and the high frequency component to output the final left channel signal in which the second vocal component is canceled; and adding the low-pass filtered second right channel and the high frequency component to output the final right channel signal in which the second vocal component is canceled.

10. A karaoke system to cancel a vocal component from an audio signal, comprising:

an audio source generation unit to generate an audio source as left and right channels;

a decoder unit to decode the audio source generated in the audio source generation unit according to a predetermined signal format to generate left and right channel input signals; and a vocal canceling unit to feed-forward-cross mix the left and right channel input signals decoded in the decoder unit, with a predetermined delay to generate left and right channel signals, to feedback-cross mix the left and right channel signals with a predetermined delay to widen a sound stage generate second left and right channel signals, to low-pass filter the second left and right channel signals of the sound stage to restrict high frequency components from low-pass components from an output of at least one low-pass filter, and to high-pass filter a difference between the second left and right channel signals that cancel a second vocal component to restrict low-pass frequency components from the output of a high-pass filter and to mix the low-pass filtered second left and right channel signals of the low frequency components output from the at least one low pass filter with a high frequency component output from the high pass filter to generate final left and right channel signals.

11. A computer readable recording medium containing computer readable codes to perform a method, the method comprising:

delaying left and right channel input signals and feed-forward cross mixing the delayed channel input signals with the right and left channel input signals to cancel a first vocal component from the left and right channel input signals to generate left and right channel signals;

delaying the left and right channel signals and feedback-cross mixing the delayed left and right channel input with the left and right signals to widen a sound stage to generate second left and right channel signals; and low-pass filtering the second left and right channel signals of the sound stage to restrict high frequency components therefrom, and high-pass filtering a difference between the second left and right channel signals that cancel a second vocal component to restrict low-pass frequency components from the output of the high-pass filtering, and mixing the low-pass filtered second left and right channel signals of low frequency components output from the low pass filtering with a high frequency component output from the high pass filtering to generate final left and right channel signals.

12. An apparatus to cancel a vocal component from an audio signal, comprising:

a first vocal canceling unit to delay or gain control left and right channel input signals and to subtract the delayed or gain-controlled left and right channel input signals to the right and left channel input signals, respectively, to generate left and right channel signals; and a second vocal canceling unit to obtain low frequency components by restricting high-pass frequency components from the left and right channel signals output from a sound stage widening unit using at least one low-pass filter, and to obtain a high frequency component by restricting low-pass frequency components from a difference between the left and right channel signals using a high-pass filter, and to add the high frequency component from the high-pass filter to each of the low frequency components of the left and right channel signals output by the at least one low-pass filter to generate final left and right channel signals.

13. The apparatus of claim 12, further comprising:

a sound stage widening unit to delay or gain-control the left and right channel signals and to add the delayed or gain-controlled left and right channel signals to the right and left channel signals to generate second left and right channel signals, wherein the second vocal canceling unit obtains low frequency components from the second left and right channel signals, obtains the high frequency component from a difference between the second left and right channel signals, and adds the high frequency component to each of the low frequency components of the second and left channel signals to generate the final left and right channel signals.

14. The apparatus of claim 13, wherein the sound stage widen unit delays or gain-controls the second left and right channel signals to obtain the delayed or gain controlled left and right channel signals.

15. The apparatus of claim 13, the sound stage widening unit comprises:

at least one of a first delay and a first gain-controller to delay or gain-control the second left channel signal to generate the delayed or gain-controlled left channel signal;

at least one of a second delay and a second gain controller to delay or gain-control the second right channel signal to generate the delayed or gain controlled right channel signal;

a left adder to add the left channel signal to the delayed or gain-controlled right channel signal to generate the second left channel signal; and a right adder to add the right channel signal to the delayed or gain controlled left channel signal to generate the second right channel signal.

16. The apparatus of claim 12, wherein the first vocal canceling unit comprises:

at least one of a first delay and a first gain-controller to delay or gain-control the left channel input signal;

at least one of a second delay and a second gain-controller to delay or gain-control the right channel input-signal;

a first subtracter to subtract the delayed or gain-controlled right channel signal to the left channel input signal to generate the left channel signal; and a second subtracter to subtract the delayed or gain-controlled left channel signal to the right channel signal to generate the right channel signal.

17. An apparatus to cancel a vocal component from an audio signal, comprising:

a sound stage widening unit to delay or gain-control left and right channel signals and to add the delayed or gain-controlled left and right channel signals to the right and left channel signals to generate second left and right channel signals; and a vocal canceling unit to obtain low frequency components by restricting high-pass frequency components from the second left and right channel signals output from a sound stage widening unit using at least one low-pass filter, and to obtain a high frequency component by restricting low-pass frequency components from a difference between the second left and right channel signals using a high-pass filter, and to add the high frequency component from the high-pass filter to each of the low frequency components of the second left and right channel signals output by the at least one low-pass filter to generate final left and right channel signals.

18. The apparatus of claim 17, wherein the sound stage widening unit delays or gain-controls the second left and right channel signals to generate the delayed or gain-controlled left and right channel signals.

19. The apparatus of claim 17, further comprising:

another vocal canceling unit to cancel a vocal component from left and right channel input signals of an audio signal to generate the left and right channel signals.

20. An apparatus to cancel a vocal component from an audio signal, comprising:

a first vocal canceling unit that generates left and right non-amplified input signals and left and right amplified input signals and that delays the left and right amplified input signals to generate left and right delayed signals and that subtracts the delayed left signal from the right non-amplified signal to generate a right channel signal excluding a voice component and that subtracts the delayed right signal from the left non-amplified signal to generate a left channel signal excluding a voice component;

a sound stage widening unit to widen a sound stage of the left and right channel signals to generate second left and right channel signals; and a second vocal canceling unit including a high-pass filter to output a high frequency component of a difference between the second left and right channel signals, and to mix low frequency components generated by restricting high-pass frequency components from the left and right channel signals of output by the sound stage widening unit with the high-pass frequency component output from the high-pass filter to generate a final left and right channel signals.

21. The apparatus of claim 20 wherein the second vocal canceling unit further comprises a low-pass filter to filter the second left and right channel signals output from the sound stage widening unit to generate the low frequency components and to mix the filtered left and right channel signals of low frequency components with the high frequency component obtained from the difference between the second left and right channel signals to cancel a second vocal component to generate the final left and right channel signals.

* * * * *